United States Patent [19]

Waller et al.

[11] Patent Number: 4,810,405

[45] Date of Patent: Mar. 7, 1989

[54] RUST REMOVAL AND COMPOSITION THEREOF

[75] Inventors: John E. Waller, Mississauga; John A. Gray, Etobicoke; David A. Aston, Oakville, all of Canada

[73] Assignee: Dearborn Chemical Company, Limited, Mississauga, Canada

[21] Appl. No.: 111,898

[22] Filed: Oct. 21, 1987

[51] Int. Cl.[4] ..... C02F 5/14

[52] U.S. Cl. ..... 252/81; 134/2; 134/3; 252/86; 252/181; 422/14; 422/15

[58] Field of Search ..... 252/81, 86, 181; 134/2, 134/3; 422/14, 15

[56] References Cited

U.S. PATENT DOCUMENTS

| | | | |
|---|---|---|---|
| 3,072,502 | 1/1963 | Alfano | 134/3 |
| 3,803,047 | 4/1974 | Hwa | 252/181 |
| 3,803,048 | 4/1974 | Hwa | 252/181 |
| 3,879,288 | 4/1975 | Siegele | 252/181 |
| 3,898,037 | 8/1975 | Lange et al. | 21/2.7 R |
| 3,941,562 | 3/1976 | Hollingshad | 21/2.7 R |
| 4,067,690 | 1/1978 | Cuisia et al. | 21/2.7 R |
| 4,132,526 | 1/1979 | Schwarz et al. | 422/1 |
| 4,278,635 | 7/1981 | Kerst | 422/14 |
| 4,279,768 | 7/1981 | Busch | 252/81 |
| 4,342,652 | 8/1982 | Schiller et al. | 210/698 |
| 4,350,606 | 8/1982 | Cuisia et al. | 252/392 |
| 4,430,128 | 2/1984 | Frenier et al. | 134/3 |
| 4,600,524 | 7/1986 | Cuisia et al. | 252/181 |
| 4,631,131 | 12/1986 | Cuisia et al. | 210/697 |
| 4,649,025 | 3/1987 | Hwa et al. | 422/15 |
| 4,664,811 | 5/1987 | Operhofer | 210/673 |

FOREIGN PATENT DOCUMENTS

| | | | |
|---|---|---|---|
| 0216586 | 1/1987 | European Pat. Off. . | |
| 57-015895 | 1/1982 | Japan | 252/81 |
| 2157322 | 10/1985 | United Kingdom . | |

OTHER PUBLICATIONS

1983 The Merck Index—10th Edition, p. 4961.

5/87 Water Treatment Report—p. 19.

8/84 Poulos—"A Comparative Study on the Dissolution of Magnetite by Organic Acids", pp. 19–21, Materials Performance.

1984 Frenier—"The Mechanism of Magnetite Dissolution in Chelant Solutions", pp. 176, 178, 190—Corrosion vol. 40, No. 4.

*Primary Examiner*—Robert A. Wax

*Attorney, Agent, or Firm*—David E. Heiser

[57] ABSTRACT

Iron oxide deposits are removed from substrates by use of aqueous solution at approximately neutral pH containing a phosphonate (e.g., hydroxyethylidene diphosphonic acid), a reducing agent (e.g., sodium sulfite), and a corrosion inhibitor (e.g., benzotriazole). Optionally, a surfactant and dispersant may be included.

18 Claims, No Drawings

RUST REMOVAL AND COMPOSITION THEREOF

FIELD OF THE INVENTION

The invention relates to removal of iron oxide from a metal surface or other substrate, using a multicomponent descalant.

SUMMARY OF THE INVENTION

The invention involves a novel descalant composition and the method of its use. The composition includes a phosphonate (suitably hydroxyethylidene-diphosphonic acid (HEDPA)) as a primary descalant and iron-dissolving agent; a reducing agent (suitably isoascorbic acid, sodium sulfite, or mixtures thereof); and an anticorrosion agent (suitably benzotriazole). Optionally, the composition may also include a surfactant or wetting agent, suitably an amphocarboxylate; and/or a dispersant, suitably a polyacrylate.

The composition is designed for use at approximately neutral pH conditions, although it is still functional on either side of pH=7. It is particularly valuable for removal of iron oxides and rust deposits in closed systems, including process boilers, heat exchangers, holding tanks, and pipelines. Also, rusted articles can be descaled by immersion in an aqueous solution or dispersion of the invention composition.

The aim of a good rust-remover is to maximize the rate of rust removal while at the same time minimizing corrosion to the base metal. Unfortunately, these two aims are mutually exclusive in practice, since in the general case rust is removed by a process that inherently results in some corrosion. Realistically, therefore the best descalants aim at providing efficient cleaning while keeping corrosion within acceptable limits. Our composition succeeds admirably in this respect, and in addition provides a passive surface.

Each individual component of the invention composition is known for the same function or property as used in our composition. Our invention lies in the selection, combination, and proportions of the individual components out of literally thousands of inferior possibilities, as will be explained in detail below.

TECHNOLOGY

Phosphonates are known for use in removing iron oxides from the surfaces of metals and other substrates:

U.K. Patent Application, GB No. 2,157,322A, published Oct. 23, 1985 (Diversey Limited), uses a combination of a phosphonate (which can be HEDPA) and ferrous ions on various metals, plastics, and fabrics.

U.S. Pat. No. 4,664,811 of May 12, 1987 (application filed July 1, 1985) (Nalco Chemical Co.) discloses the combination of a reducing agent (which may be erythorbic acid—i.e., isoascorbic acid) and a phosphonate in cleaning iron oxides from ion exchange resins.

It is known that dissolved oxygen in boiler waters promotes corrosion and rust formation, and various oxygen-scavenging systems have been developed to deal with the problem, with a view to minimizing iron oxide formation in the first place. Some of these oxygen scavengers are also reducing agents, sodium sulfite, hydrazine, etc., being typical. See, e.g., European Patent Application No. 0 216 586, filed Sept. 12, 1986, published Apr. 1, 1987 (Calgon Corp.) which discloses a chelated sodium erythorbate. The chelant is, e.g., NTA or EDTA.

Our reducign agents do not function primarily as oxygen scavengers; by this we mean, they contribute to iron oxide removal whether or not oxygen is present.

Descalants containing polycarboxylic acids are well known. See U.S. Pat. No. 3,072,502 (citric acid) and U.S. Pat. No. 4,664,811 (EDTA, NTA, etc.). Compositions in the latter patent also include a reducing agent. Also see C.A. Poulos, Materials Performance 19–21 (Aug., 1984); and W.W. Frenier, Corrosion, 40, No. 4, 176–180 (Aug., 1984).

HEDPA is known in combination with other materials for corrosion inhibition: U.S. Pat. No. 3,803,047 teaches use with benzotriazole; U.S. Pat. No. 3,803,048 teaches use with zinc salts.

DETAILED DESCRIPTION OF THE INVENTION

In its simplest aspect our descalant solution contains only a phosphonate, a reducing agent, and a corrosion inhibitor, as actives, as will now be described.

EXAMPLE 1

Here we used a 3-component descalant, via., HEDPA, isoascorbic acid as reducing agent, and benzotriazole as corrosion inhibitor, omitting dispersant and surfactant. The preferred composition includes these two latter materials; nevertheless the basic 3-component composition of phosphonate, reducing agent, and corrosion inhibitor is technically effective, as this Example shows. Note that this formulation, cut to the 3 bare essential ingredients, gives substantially perfect cleaning, plus a final passive surface.

In this Example 1 the item cleaned was a 100-gallon mild steel chemical feed tank, which had a light coating of rust over the entire inner surface. We filled the tank with 500 liters of cold (5° C.) tap water and added 10.5 kg HEDPA (final concentration, 1.26% active), 500 g isoascorbic acid, and 50 g benzotriazole (final concentration, 0.1 and 0.01%, respectively). The initial pH was adjusted to 7.45 with NaOH, and the solution was stirred continuously. After 24 hours the pH was 7.6 and the temperature was 10° C., and after 48 hours the pH was 7.8 and the temperature 20° C., whereupon the tank was drained and rinsed. It was completely free of rust and remained dull gray and rust-free for 10 weeks sitting out in a chemical factory environment.

EXAMPLE 2

A closed hot water heating system in a commercial building was used in this example. It consisted of two 100 horse-power Cleaver Brooks boilers, and the piping necessary to service the building. the internals of the boiler and the piping were covered with a hard, red-brown deposit, a sample of which was analyzed to contain 92% iron oxide, plus minor amounts of calcium and magnesium-based scale.

The system was filled with city water plus our preferred formulation at 10% concentration (per Column 2 in Table I herein), and the mixture was circulated throughout the system, unheated. During the cleaning, the pH of this system rose slightly and was adjusted twice from 7.3–7.5 down to 6.7–6.8 using HEDPA.

After 12 days, the system was drained and flushed with water. Visual inspection of the boiler showed that the surface had changed from red-brown to gray-black and about 85–90% of the deposit had been removed. That which remained was soft and easily brushed off.

The hard deposits in the piping had been almost completely removed and the surface was gray-black.

Corrosiont esters, suspended in the broiler for the 12 days of the cleaning, gave the following corrosion rates:

Mild Steel=19.4 mpy

Copper=0.0 mpy

Admiralty Brass=0.1 mpy

Aluminum=0.24 mpy clearly demonstrating the low corrosivity of this cleaning solution.

After cleaning was complete, untreated city water was recirculated for 24 hours. This caused no fresh rusting of the system, showing the passive nature of the cleaned surface; and the recirculated water was low in suspended solids, showing that all suspended material had been removed during the initial draining of the boiler.

Analysis of the final cleaning solution showed it to contain 2,740 ppm soluble iron (expressed as $Fe_2O_3$), 1,030 ppm calcium and 170 ppm magnesium (both expressed as calcium carbonate), showing that the cleaning had removed the mineral-based scales as well as the iron oxides.

The system was put back into operation and experienced no operating problems.

We particularly noted that our descalant solution effected removal of mineral-based scale. This had not been expected.

In a preferred embodiment we prepared a concentrate, which is diluted in use. A preferred formulation is given in Table I.

TABLE I

| Component | Wt. %[1] in Concentrate | As diluted in Treatment Water, Wt. % |
|---|---|---|
| HEDPA | 7 | 0.7 |
| Sodium sulfite | 1.1 | 0.11 |
| Benzotriazole | 0.1 | 0.01 |
| Surfactant[2] | 1 | 0.1 |
| Dispersant[3] | 3 | 0.3 |
| NaOH; to adjust pH to 6.5-7.6 | 5.2 | 0.52 |
| Water | Balance to make 100% | Balance to make 100% |

[1]All percentages calculated on amount of active.

[2]An amphoteric surfactant, available commercially as Miranol JEM CONC, a mixed C8-amphocarboxylate derived from mixed caprylic and hexoic acids, from Miranol Chemical Co.

[3]A polyacrylate, about 4,500 molecular weight, available commercially as Colloid 117/40 from Colloid Canada Ltd.

It will be noted that the formulation results in the formation of sodium salts of several of the components, in particular, HEDPA and the dispersant. Other alkalis can be used instead of NaOH, eg. KOH, ammonium hydroxide, and the like. Preformed neutral salts can be used in lieu of the addition of alkali.

In Table I it will be noted that the solids, dry basis, consist essentially as stated in Table II.

TABLE II

| Component | Wt. % |
|---|---|
| HEDPA | 40.2 |
| Sodium sulfite | 6.3 |
| Benzotriazole | 0.6 |
| Surfactant | 5.7 |
| Dispersant | 17.2 |
| NaOH | 30.0 |
| | 100.0 |

The percentages of solids in Table II can vary, though within fairly narrow limits, as shown in Table III.

TABLE III

| Component | Workable Range, wt. %[1] | Preferred Range, wt. %[1] |
|---|---|---|
| HEDPA | 25-55 | 35-45 |
| Sodium sulfite | 2-10 | 4-8 |
| Benzotriazole | .2-1.0 | .4-.8 |
| Surfactant | 2-10 | 4-8 |
| Dispersant | 10-25 | 14-21 |
| NaOH[2] | | |

[1]Components should be proportioned such that the aggregate totals 100%. Thus. not all can be used in a given formulation at their respective lower or upper range limits.

[2]As necessary to provide pH 6.5-7.6 in the final cleaning solution.

In a broad sense our invention contemplates the use of a concentrate as shown in Table IV, including its dilution.

TABLE IV

| Component | Wt. % (of active) Ranges In Concentrate | |
|---|---|---|
| | Workable | Preferred |
| Phosphonate | 3-11 | 5-9 |
| Reducing Agent | 0.5-2.0 | 0.8-1.4 |
| Corrosion Inhibitor | 0.05-0.20 | 0.08-0.14 |
| Surfactant | 0-5 | 0.5-2.0 |
| Dispersant | 0-8 | 2.0-4.0 |
| Water[1] | | |
| NaOH[2] | | |

[1]Water added in all formulations to make 100%.

[2]As necessary to provide pH 6.5-7.6 in the final cleaning solution.

In practical use the concentrate product will be added to, and diluted by, water. The most preferred dilution of any concentrate (to make the use solution) would be about 9-11% weight of concentrate; preferably, about 7-14%; and workable, about 3-20%. Thus, it can be calculated from the "workable" ranges in Table IV, as applied to a dilution range of 3-20%, that the resulting diluted solution would consist essentially of phosphonate, 0.09-2.2 (i.e., $3\times0.03-11\times0.2$) weight %; reducing agent 0.015-0.4%; corrosion inhibitor 0.0015-0.04%; surfactant 0-1.0%; dispersant 0-1.6%, with sufficient NaOH to adjust pH to 6.5-7.6. Similar conversions are readily calculated for "preferred" amounts in Table 4, with the preferred and most preferred dilutions as stated.

Useful corrosion inhibitors include benzotriazole tolyltriazole, their alkali metal salts, and other inhibitors listed in Table VIII.

Useful reducing agents include sodium sulfite; isoascorbic acid (erythorbic acid) and its alkali metal salts; diethylhydroxylamine (DEHA); glucose; and hydrazine.

Useful surfactants include Miranol JEM CONC an amphocarboxylate thought to belong to the class of amphoteric surfactants known as carboxylated imidazolines and to comprise a carboxyalkyl derivative of 1-hydroxyethyl alkyl ($C_8$) imidazone.

Useful dispersants include Colloid 117/40 and Cyanamer P-80, a copolymer of allyl sulfonic acid and maleic anhydride, available from American Cyanamid Co.

If desired, the actives can be compounded as a dry mixture, using the same weight ratios as indicated for the concentrate.

TREATMENT PROCESS

In its simplest aspect the invention process involves contacting the rust-surface substrate with the use solution (i.e., diluted concentrate). A dilution within the ranges specified in Table I or as described above is chosen, and the solution is applied to the substrate or vice versa. For use in cycling systems we prefer that the concentrate be added at the earliest feasible point in the system. The amount to be added is calculated from the total amount of water in the system, so as to provide and maintain the requisite percentage of composition within the system. With respect to static systems, the rusted substrate is simply submerged in the dilute solution and kept there, suitably with agitation, until the iron oxide is dissolved.

We describe below how we arrived at the selection and proportions of components of our compositions. In particular, the data are of value in selection of alternate components for the treatment of various substrates and under a variety of conditions. In all the following tests, unless stated otherwise, coupons of rusty steel were immersed in 1 liter of the stated solution, and shaken or stirred, at room temperature.

SELECTION OF PHOSPHONATE IRON SOLUBILIZER

We tried five phosphonate materials, including HEDPA, each at 1% active, with 0.1% isoascorbic acid. At this stage our primary consideration was to find a material that would achieve a high dissolved iron level, regardless of corrosion considerations. In studying the phosphonates, we noted that HEDPA solubilized $Fe_2O_3$ the fastest of the candidates tried, although in some cases it gave a higher corrosion rate. We therefore selected HEDPA as our preferred base iron solubilizer. Results are given in Table V.

TABLE V

Iron Oxide Solubilization by Five Phosphonates

| TEST SOLUTIONS | | | | | | |
|---|---|---|---|---|---|---|
| Phosphonate 1.0% active[1] | % Iso-ascorbic Acid | Initial pH | Corrosion Rate mpy | Iron Level $Fe_2O_3$ 1 hr/20 hrs/72 hrs | | |
| 1 AMP | 0.1 | 7.5 | 12.9 | 43 | 165 | 935 |

TABLE V-continued

Iron Oxide Solubilization by Five Phosphonates

| TEST SOLUTIONS | | | | | | |
|---|---|---|---|---|---|---|
| Phosphonate 1.0% active[1] | % Iso-ascorbic Acid | Initial pH | Corrosion Rate mpy | Iron Level $Fe_2O_3$ 1 hr/20 hrs/72 hrs | | |
| 2 Dequest 2054 | 0.1 | 7.4 | 8.4 | 8 | 105 | 560 |
| 3 Bayhibit AM | 0.1 | 7.4 | 7.4 | 70 | 400 | 860 |
| 4 Ciba Geigy DP3175 | 0.1 | 7.5 | 12.1 | 58 | 470 | 1125 |
| 5 HEDPA | — | 7.3 | 12.5 | 95 | 760 | 1600 |
| 6 HEDPA | 0.1 | 7.5 | 10.5 | 82 | 570 | 1350 |
| 7 HEDPA | 0.5 | 7.4 | 10.8 | 102 | 650 | 1475 |
| 8 HEDPA | 1.0 | 7.3 | 11.4 | 102 | 700 | 1625 |
| 9 None | 0.1 | 7.3 | 1.4 | 8 | 36 | 78 |

[1]AMP is triaminomethyl phosphonic acid, (i.e., $N—(CH_2PO_3H_2)_3$).
Dequest 2054 is the potassium salt of hexamethylenediaminetetra phosphonic acid.
Bayhibit AM is a phosphono carboxylic acid, also known as PBS-AM, 2-phosphonobutane tricarboxylic acid-1,2,4 (Bayer Chemical Ltd.)
Ciba-Geigy DP3175 is phosphono-hydroxy-acetic acid, $H_2O_3P—C(OH)-H—COOH$.

SELECTION OF REDUCING AGENT

We investigated eight reducing agents, each at 0.1% active, with HEDPA and with Bayhibit AM. Five gave clean coupons after 1 hour: isoascorbic acid (IAA), diethylhydroxylamine (DEHA), sodium sulfite, glucose, and hydrazine. Results are given in Table VI.

Usein in combination with HEDPA and benzotriazole (with or without dispersant), sodium sulfite gives a lower corrosion rate than isoascorbic acid, as shown in Table VII.

Although our work has shown that isoascorbic acid is a workable reducing agent in the general case, we note that replacement of isoascorbic acid with sodium sulfite dramatically reduces the corrosion rate. On the other hand, when we replace half of the HEDPA with dispersant, the corrosion rate is reduced when using isoascorbic acid and is slightly increased when using sodium sulfite. On the whole, however, when amounts are used as given in TABLE I, sodium sulfite is the reducing agent of choice.

When isoascorbic acid is used as the reducing agent, we found a level of 0.1–1% increased the rate of rust removal, with the optimum level being about 0.1–0.3%.

TABLE VI

TESTS OF REDUCING AGENTS[1]

| No. | Phosphonate | Reducing Agent | pH Initial | pH Final | Corrosion Rate mpy | Iron Level (ppm $Fe_2O_3$) and Observations of rusty coupon after 1 Hour | 3 Hours | 72 Hours |
|---|---|---|---|---|---|---|---|---|
| 1 | Dequest 2010 | Isoascorbic Acid | 7.7 | 8.0 | 45.6 | 20 clean | 28 clean | 575 |
| 2 | Bayhibit AM | Isoascorbic Acid | 7.4 | 8.0 | 32.2 | 5 no change | 29 partly clean | 375 |
| 3 | Dequest 2010 | DEHA | 7.4 | 9.1 | 61.9 | 21 clean | 33 clean | 775 |
| 4 | Bayhibit AM | DEHA | 7.4 | 10.1 | 55.4 | 7 no change | 35 partly clean | 663 |
| 5 | Dequest 2010 | Sodium Sulphite | 7.4 | 7.4 | 22.3 | 17 clean | 19 clean | 308 |
| 6 | Bayhibit AM | Sodium Sulphite | 7.4 | 7.4 | 8.2 | 15 nearly clean | 18 nearly clean | 76 |
| 7 | Dequest 2010 | Sodium Gluconate | 7.4 | 7.8 | 50.6 | 15 partly clean | 31 clean | 663 |
| 8 | Bayhibit AM | Sodium Gluconate | 7.4 | 8.1 | 36.2 | 7 no change | 32 partly clean | 425 |
| 9 | Dequest 2010 | Glucose | 7.5 | 7.8 | 54.6 | 21 clean | 32 clean | 750 |
| 10 | Bayhibit AM | Glucose | 7.5 | 8.1 | 35.2 | 6 no change | 15 no change | 400 |
| 11 | Dequest 2010 | Hydrazine | 7.4 | 7.4 | 59.0 | 18 clean | 29 clean | 750 |
| 12 | Bayhibit AM | Hydrazine | 7.5 | 7.6 | 52.1 | 6 no change | 30 nearly clean | 650 |
| 13 | Dequest 2010 | Kelig 100 | 7.5 | 7.6 | 33.2 | 20 black | 27 black | 445 |
| 14 | Bayhibit AM | Kelig 100 | 7.5 | 7.7 | 14.5 | 19 nearly clean | 26 nearly clean | 178 |
| 15 | Dequest 2010 | Hydroxyacetic Acid | 7.5 | 7.7 | 47.3 | 5 no change | 29 clean | 638 |
| 16 | Bayhibit AM | Hydroxyacetic Acid | 7.5 | 8.0 | 30.9 | 6 no change | 14 no change | 345 |

[1]Dequest 2010 is HEDPA (Monsanto Chemical Co.).
DEHA is diethylhydroxylamine.
Kelig 100 is a lignosulfonate.

TABLE VII

| TREATMENT (ppm) | 1 | 2 | 3 | 4 | 5 | 6 |
|---|---|---|---|---|---|---|
| HEDPA (active) | 10,000 | 5,000 | 10,000 | 10,000 | 10,000 | 5,000 |
| Isoascorbic Acid | 1,000 | 500 | 500 | 1,000 | None | None |
| Benzotriazole | 100 | 100 | 100 | 100 | 100 | 100 |
| Sodium Sulphite | None | None | 600 | None | 1,100 | 600 |
| Sodium Nitrite | None | None | None | 1,000 | None | None |
| Average Corrosion Rates (mpy) | 51.3 | 42.5 | 24.6 | 68.4 | 3.67 | 10.1 |
| | 49.7, 49.5 | 41.0, 43.5 | 23.9, 22.4 | 64.9, 67.6 | 3.48, 3.48 | 10.7, 8.53 |
| | 54.8, 51.3 | 42.9, 42.4 | 25.8, 26.4 | 70.1, 71.2 | 3.64, 4.06 | 10.4, 10.8 |
| TREATMENT (ppm) | 7 | 8 | 9 | 10 | 11 | 12 |
| HEDPA (active) | 5,000 | 5,000 | 5,000 | 5,000 | 5,000 | 5,000 |
| Isoascorbic Acid | 1,000 | 1,000 | 500 | 500 | None | None |
| Benzotriazole | 100 | 100 | 100 | 100 | 100 | 100 |
| Sodium Sulphite | None | None | 600 | 600 | 1,100 | 1,100 |
| Colloid 117/40 (active) | 5,000 | None | 5,000 | None | 5,000 | None |
| Cyanamer P-80 (active) | None | 5,000 | None | 5,000 | None | 5,000 |
| Average Corrosion Rates (mpy) | 35.1 | 36.1 | 20.4 | 21.4 | 6.1 | 6.3 |
| | 34.8, 33.5 | 33.4, 34.4 | 17.9, 19.0 | 20.3, 22.0 | 6.1, 6.0 | 6.4, 6.0 |
| | 38.8, 38.4 | 39.9, 36.8 | 22.8, 22.0 | 20.4, 22.8 | 6.7, 5.8 | 6.5, 6.5 |

SELECTION OF CORROSION INHIBITOR

We tested several corrosion inhibitors with 1% active HEDPA at pH 7.4, at 0.1 and 0.01% inhibitor concentrations, viz., acetyl acetone, Ethomeen T/12 (2-mole ethoxylated tallow amine), sodium metasilicate, Rodine 95 (an organic inhibitor thought to comprise a substituted triazien formulated with minor amounts of 1,3-diethyl thiourea and triphenyl sulfonium chloride), sodium molybdate.-$2H_2O$, benzotriazole, sodium hexametaphosphate, and Armohib 31 (an organic inhibitor thought to comprise a mixture of a fatty amine salt and di-N-butyl thiourea). The tests were made on coupons of mild steel, admiralty brass, and copper. While some of these materials gave reduced corrosion rates on mild steel, and other materials gave reduced corrosion rates on copper and admiralty brass, benzotriazole gave good corrosion protection on all three.

Comparative data are given in Table VIII.

SELECTION OF SURFACTANT (WETTING AGENT)

Several gave good results. Miranol JEM CONC, was selected as effective and representative.

SELECTION OF DISPERSANT

We tried several anionic polymers as dispersants in our composition. The two most effective were Colloid 117/40 and Cyanamer P-80. We were able to replace 30%-50% of HEDPA active with either of these dispersants without substantial loss of function. Furthermore, use of this dispersant decreased cleaning time. The rate of rust removal was a maximum with Colloid 117/40 using either isoascorbic acid or sodium sulfite as reducing agent; see Table IX.

TABLE VIII

Tests of Corrosion Inhibitors

| Test No. | Inhibitor | Inhibitor Level % | Corrosion Rates (mpy) Mild Steel | Copper | Admiralty Brass |
|---|---|---|---|---|---|
| 1 | Acetyl acetone | 0.1 | 48.4 | 0.63 | 0.51 |
| 2 | Acetyl acetone | 0.01 | 45.7 | 0.51 | 0.23 |
| 3 | Ethomeen T/12 | 0.1 | 18.2 | 2.07 | 0.95 |
| 4 | Ethomeen T/12 | 0.01 | 19.4 | 1.90 | 0.79 |
| 5 | Sodium metasilicate | 0.1 | 41.1 | 0.51 | 0.44 |
| 6 | Sodium metasilicate | 0.01 | 33.1 | 2.17 | 2.05 |
| 7 | Rodine 95 | 0.1 | 11.2 | 6.5 | 6.71 |
| 8 | Rodine 95 | 0.01 | 37.1 | 0.49 | 0.95 |
| 9 | Sodium molybdate | 0.1 | 24.3 | 1.19 | 1.15 |

TABLE VIII-continued

Tests of Corrosion Inhibitors

| Test No. | Inhibitor | Inhibitor Level % | Corrosion Rates (mpy) Mild Steel | Copper | Admiralty Brass |
|---|---|---|---|---|---|
| | $2H_2O$ | | | | |
| 10 | Sodium molybdate $2H_2O$ | 0.01 | 47.6 | 0.49 | 0.23 |
| 11 | Benzotriazole | 0.1 | 39.7 | 0.27 | 0.1 |
| 12 | Benzotriazole | 0.01 | 26.1 | 0.19 | 0.08 |
| 13 | Sodium hexameta phosphate | 0.1 | 45.2 | 0.34 | 0.18 |
| 14 | Sodium hexameta phosphate | 0.01 | 36.9 | 0.66 | 0.31 |
| 15 | Armohib 31 | 0.1 | 24.0 | 1.78 | 1.54 |
| 16 | Armohib 31 | 0.01 | 24.3 | 0.83 | 1.28 |
| 17 | None | — | 54.0 | 0.58 | 0.44 |

TABLE IX

Replacement of HEDPA with Dispersant

| FORMULA | | Dispersant | Rust Removal Rate | Cleaning Time (min) |
|---|---|---|---|---|
| HEDPA | IAA[1] | | | |
| 1.0 | 0.1 | | 1.2 | 130 |
| 0.7 | 0.07 | 0.3 (117/40)[2] | 1.8 | 50 |
| 0.7 | 0.07 | 0.3 (C-P80) | 0.9 | 60 |
| HEDPA | S.S.[3] | | | |
| 1.0 | 0.1 | | 1.4 | 70 |
| 0.7 | 0.07 | | 1.4 | 60 |
| 0.7 | 0.07 | 0.3 (117/40)[2] | 1.8 | 40 |
| 0.7 | 0.07 | 0.3 (C-P80)[4] | 1.0 | 50 |

[1]Isoascorbic Acid
[2]Colloid 117/40
[3]S.S. = Sodium Sulphite
[4]Cyanamer P-80

A special advantage of our formulation is lack of aggressivity toward metals commonly found in industrial systems. This is shown in Table X.

TABLE X

Corrosion Rates for Two Invention Formulations for Various Metals

| Treatment No. 1 | | Treatment No. 2 | |
|---|---|---|---|
| HEDPA | 5,000 ppm | HEDPA | 5,000 ppm |
| Na Sulphite | 1,100 ppm | IAA | 1,000 ppm |
| Colloid 117/40 | 5,000 ppm | Colloid 117/40 | 5,000 ppm |
| Benzotriazole | 100 ppm | Benzotriazole | 200 ppm |
| Corrosion Rates (mpy) for: | | | |
| Mild Steel | | 6.1 | 29.0 |
| Stainless Steel | | 0.0 | 0.0 |

TABLE X-continued

| Corrosion Rates for Two Invention Formulations for Various Metals | | |
|---|---|---|
| Aluminum | 1.4 | 2.6 |
| Brass | 1.0 | 0.0 |
| Bronze | 0.0 | 1.2 |
| Copper | 0.0 | 1.1 |
| Galvanized Steel | 32.5 | 34.1 |
| Cast Iron | 4.76 | 47.1 |

SOME GENERAL CONSIDERATIONS

The cleaning process can be carried out at room temperature, or the substrate and the solution can be heated. Increasing the temperature (e.g., to 45° C.) increases the cleaning rate, especially when sodium sulfite is used as the reducing agent.

We prefer to use the descaling solution at a pH of about 6.5–7.6. Dropping the pH to 6.5 significantly increases both the rate of rust removal and shows more increase in corrosion rate. Increasing the pH to 8.6 decreases the rust removal rate but increases the corrosion rate (see Table XI).

With many of our coupon-descaling tests, we have noted that the cleaned coupons have a gray or black surface and appeared to be passive, i.e., they did not re-rust when exposed to the original rust-generating conditions. This behavior is in direct contradiction to many of our tests comparing commercial compositions, many of which resulting in prompt re-rusting of the substrate.

Unless otherwise stated, all tests were carried out with rusted coupons of mild steel in 1,000 ml of test solution, at room temperature with the pH adjusted with, e.g. NaOH to the desired pH. Most of the tests were carried out at pH=7.2–7.6.

TABLE XI

| Rate of Rust Removal and Corrosion to Initial pH | | | |
|---|---|---|---|
| | Initial | Rate Details (ppm $Fe_2O_3$/min) | |
| Lab No. | pH | Rust Removal | Corrosion |
| 14 | 6.5 | (10–30 min.) 3.87 | (60–320 min.) +0.38 |
| 10 | 7.4 | (10–30 min.) 2.23 | (160–400 min.) −0.01 |
| 15 | 8.6 | (40–80 min.) 1.86 | (110–320 min.) +0.12 |

We claim:

1. A method of removing iron oxide from a metal substrate which includes a surface of iron or steel comprising treating the substrate with an aqueous use solution containing from about 0.09 to 2.2 weight percent of the phosphonate hydroxyethylidene diphosphonic acid, from about 0.015 to 0.4 weight percent of a reducing agent, and from about 0.0015 to 0.04 weight percent of a corrosion inhibitor selected from the group consisting of benzotriazole, tolyltriazole and their alkali metal salts.

2. A method according to claim 1 in which the pH of the use solution is from about 6.5 to 7.6.

3. A method according to claim 2 in which the reducing agent is sodium sulfite and the corrosion inhibitor is benzotriazole; in which the use solution further comprises from about 0.015 to 1.0 weight percent of a carboxylated amphoteric surfactant; and in which the use solution contains at most about 1.6 weight percent of dispersant.

4. A method according to claim 1 or claim 2 in which the reducing agent is a member of the group consisting of sodium sulfite, isoascorbic acid, diethylhydroxylamine, glucose, or hydrazine.

5. A method according to claim 1 or claim 2 in which the corrosion inhibitor is benzotriazole.

6. A method according to claim 1 or claim 2 in which the solution is maintained at a pH in the range of about 7.2–7.6.

7. An improved aqueous dispersant composition, wherein the improvement comprises a descalant concentrate in which the actives consist essentially of, in weight % of the composition, the phosphonate hydroxyethylidene diphosphonic acid, about 3–11; a reducing agent, about 0.5–2.0; a corrosion inhibitor selected from the group consisting of benzotriazole, tolyltriazole and their alkali metal salts, about 0.05–0.20; and optionally up to about 5 weight percent of a carboxylated amphoteric surfactant; and wherein the dispersant is at most, about 8 weight percent of the composition.

8. An improved composition according to claim 7 in which the phosphonate is about 5–9 weight percent; the reducing agent is about 0.8–1.4 weight percent; the corrosion inhibitor is about 0.08–0.14 weight percent; and the carboxylated amphoteric surfactant is about 0.5–2.0 weight percent.

9. An improved composition according to claim 7 or claim 8 in which the reducing agent is a member of the group consisting of sodium sulfite, isoascorbic acid, diethylhydroxylamine, glucose or hydrazine.

10. An improved composition according to claim 9 in which the corrosion inhibitor is benzotriazole.

11. An improved composition according to claim 7 or claim 8 in which a surfactant is present and is a mixed carboxylated amphoteric surfactant derived from caprylic and hexoic acid.

12. an improved composition according to claim 7 in which the phosphonate is about 7 wt. % of the composition; the reducing agent is sodium sulfite, and is about 1.1 wt. % of the composition; the corrosion inhibitor is benzotriazole, and is about 0.1 wt. % of the composition; and the carboxylated amphoteric surfactant is about 1 wt. % of the composition.

13. An improved dispersant composition, wherein the improvement comprises a descalant formulation consisting essentially of dry basis actives, in weight % of the composition: Hydroxyethylidene diphosphonic acid, about 40.2; sodium sulfite, about 6.3; benzotriazole, about 0.6; carboxylated amphoteric surfactant derived from mixed caprylic and hexoic acids, about 5.7; and NaOH, about 30.0.

14. Method according to claim 1 wherein mineral-based scale is also removed.

15. An aqueous descalant composition comprising:

(a) from about 0.09 to all weight percent hydroxyethylidene diphosphonic acid;

(b) from about 0.015 to 12 weight percent of a reducing agent selected from the group consisting of sodium sulfite, isoascorbic acid, diethylhydroxylamine, glucose and hydrazine; and (c) from about 0.0015 to 0.2 weight percent of a corrosion inhibitor selected from the group consisting of benzotriazole, tolyltriazole and their alkali metal salts; the weight ratio of said components (a), (b) and (c) in said composition being about 3 to 11 parts component (a): 0.5 to 2 parts component (b): 0.05 to 0.2 parts component (c).

16. The aqueous descalant composition of claim 15 wherein the hydroxyethylidene diphosphonic acid is from about 5 to 9 weight percent of said composition, the reducing agent is from about 0.5 to 2 weight percent of said composition, and the corrosion inhibitor is from about 0.05 to 0.2 weight percent of said composition.

17. The aqueous descalant composition of claim 15 wherein the reducing agent is sodium sulfite and the corrosion inhibitor is benzotriazole.

18. The aqueous descalant composition of claim 17 further comprising a carboxylated amphoteric surfactant.

* * * * *